US006467192B1

(12) United States Patent
Egtvedt

(10) Patent No.: US 6,467,192 B1
(45) Date of Patent: Oct. 22, 2002

(54) METHOD AND APPARATUS FOR FUNCTIONALLY COVERING FOOTWEAR OF VARIOUS SIZES AND SHAPES

(75) Inventor: Robert Burnel Egtvedt, Three Churches, WV (US)

(73) Assignee: Tingley Rubber Corporation, South Plainfield, NJ (US)

( * ) Notice: Subject to any disclaimer, the term of this patent is extended or adjusted under 35 U.S.C. 154(b) by 0 days.

(21) Appl. No.: 09/417,696

(22) Filed: Oct. 13, 1999

(51) Int. Cl.[7] ..... A43B 1/10

(52) U.S. Cl. ..... 36/7.3; 36/93; 36/117.6; 36/88; 36/7.1 R

(58) Field of Search ..... 36/7.1 R, 7.2, 36/7.3, 7.4, 7.8, 88, 93, 97, 117.6, 117.9; 12/142 E, 142 EV

(56) References Cited

U.S. PATENT DOCUMENTS

| | | | | | |
|---|---|---|---|---|---|
| 11,947 | A | * | 11/1854 | Pease | 36/7.3 |
| 1,954,122 | A | * | 4/1934 | Fiori | 36/7.1 R |
| 3,026,635 | A | | 3/1962 | Slade | 36/7.3 |
| 3,389,481 | A | | 6/1968 | England | 36/2.5 |
| 3,419,974 | A | * | 1/1969 | Lange | 36/117.6 |
| 3,431,658 | A | * | 3/1969 | Finn | 36/88 |
| 4,366,629 | A | | 1/1983 | Scherz | 36/4 |
| 4,489,509 | A | | 12/1984 | Libit | 36/7.1 |
| 4,516,336 | A | * | 5/1985 | Nissenbaum | 36/7.1 R |
| 4,747,221 | A | | 5/1988 | Hayes | 36/119 |
| 4,785,556 | A | | 11/1988 | Blair | 36/7.3 |
| 4,979,319 | A | | 12/1990 | Hayes | 36/117 |
| 5,067,257 | A | * | 11/1991 | Coomer | 36/93 |
| 5,396,717 | A | | 3/1995 | Bell | 36/7.3 |
| 5,425,186 | A | | 6/1995 | Hoyt | 36/97 |

* cited by examiner

*Primary Examiner*—Mickey Yu
*Assistant Examiner*—Jila M. Mohandesi
(74) *Attorney, Agent, or Firm*—Kenyon & Kenyon

(57) ABSTRACT

A method and apparatus for functionally covering footwear of various sizes and shapes is provided. In one embodiment an overshoe, having an upper portion with an inside portion and a heel portion is provided. A first inwardly protruding deformable absorber, which is adapted to restrain footwear placed within the overshoe, is then located within the upper portion of the overshoe.

37 Claims, 6 Drawing Sheets

METHOD AND APPARATUS FOR FUNCTIONALLY COVERING FOOTWEAR OF VARIOUS SIZES AND SHAPES

FIELD OF THE INVENTION

The invention generally regards overshoes for covering footwear. More specifically the invention relates to an overshoe that can functionally cover footwear of various sizes and shapes.

BACKGROUND OF THE INVENTION

It is general practice to cover footwear with rubber overshoes or PVC overshoes to protect the footwear from inclement weather and to protect the wearer's feet from both crushing and sudden impacts.

In the past shoes generally shared the same shape so that shoes of the same size shared similar exterior dimensions. Today, conversely, there are: dress, casual, athletic, work, insulated, and safety shoes—including both steel toe and metatarsal protection boots—most of which do not share the same or even similar exterior dimensions. Due to today's broad selection of available footwear, a similarly broad selection of overshoes, to properly and safely cover the various styles of footwear, has emerged. Some of the available overshoes have been designed to be worn over a single style and size of shoe while others have been designed to accommodate several sizes of a single style of shoe.

The single size and style overshoe, often a rubber galosh for a dress shoe, is not designed to accept other sizes or styles of shoes. Known overshoes that are designed to accept various sizes of shoes accomplish this by employing accordion-like panels that expand to accept shoes of different sizes. An example of an overshoe employing these accordion style panels is illustrated in U.S. Pat. No. 3,026,635, issued to Duncan E. Slade, entitled "Overshoe," and incorporated herein by reference. While these accordion style overshoes can accept multiple sizes of shoes they become ineffective over time as the accordion sides open, stretch, and become deformed after each insertion and removal of the shoe into and out of the overshoe. In addition to becoming stretched, the accordion panels are also susceptible to unwanted opening or unfolding. For example, not needing the sides to unfold, a smaller shoe placed within the overshoe can become loose and even slip out of the overshoe if the accordion sides unintentionally unfold, thereby creating a potentially hazardous situation.

In addition, if an overshoe was designed for a size nine boot, and a size eight or seven boot was instead placed inside, the person wearing the overshoe would experience difficulty in walking. During each step the toe of the wearer would float within the toe portion of the overshoe and the heel of the wearer would slip into and out of the heel cup portion of the overshoe. The wearer would be burdened by this poor functional fit as the heel of the overshoe would sag away from the wearer's foot and strike the ground before the heel of the shoe during each step. This sagging away from the shoe is awkward, uncomfortable, and hazardous.

Similarly, in the past it has been difficult to use an overshoe to cover various styles of footwear. For example, for an over-the-sock work-boot that is both insulated and has a thick sole, it is unlikely that it will fit into an overshoe designed for a dress shoe, which is not insulated and contains a thinner sole. Conversely, if the overshoe was designed for a work-boot the overshoe would be too large for effective use by the dress shoe. The dress shoe, narrower and shorter in length than the work-boot, would slide around within the toe of the overshoe and would slip out of the heel of the overshoe during each step, as described above.

Therefore, what is needed is an overshoe that can accommodate both multiple styles and multiple sizes of shoes without the shortcomings encountered in the past.

SUMMARY OF THE INVENTION

A method and apparatus for functionally covering footwear of various sizes and shapes is provided. In one embodiment an overshoe, having an upper portion with an inside portion and a heel portion, is provided. A first inwardly protruding deformable absorber, which is adapted to restrain footwear placed within the overshoe, is then located within the upper portion of the overshoe.

The invention overcomes the problems known in the past as the overshoe can functionally secure and cover footwear of various sizes and shapes.

DETAILED DESCRIPTION

A novel method and apparatus for functionally covering various sizes and shapes of footwear is provided.

Due to the numerous styles, types, and sizes of footwear such as dress shoes, sneakers, boots, sandals, and socks, the location and size of gaps between an overshoe and footwear placed therein will vary. In one embodiment of the present invention internal deformable absorbers or mounds are used to fill these voids in order to provide a snug, functional, and safe fit for the footwear placed within the overshoe. These deformable absorbers can be located at the toe, vamp, top, and heel of the overshoe in order to absorb or fill the gaps between the overshoe and the footwear. They can also be placed in alternative locations within the overshoe, depending upon the specific function and purpose of the overshoe, in order to fill the gaps between the overshoe and the footwear placed therein.

As compared with the accordion systems known in the past the deformable absorbers do not substantially increase the surface area of the overshoe. While the outer surface area of the overshoe may slightly increase due to the deformation of an absorber that has been integrally formed as part of the overshoe, this is different from the deliberate expansion of the outer surface of the overshoe as employed in the accordion systems of the past.

The distinctions and benefits over the previously known systems are apparent as set forth in the description below and the appended drawings.

Figure 1A:
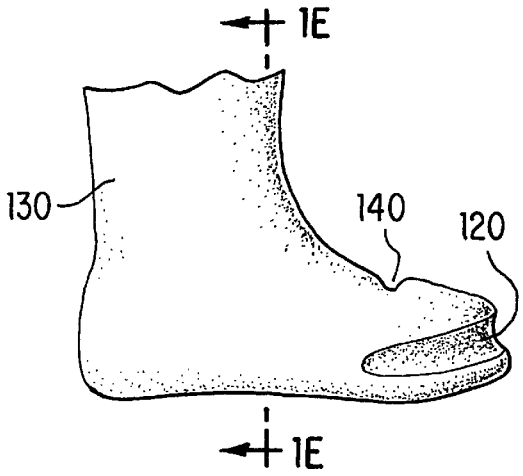
FIG. 1A illustrates a side view of one embodiment of the present invention.

FIG. 1A is a side view of one embodiment of the present invention. The overshoe 130 illustrated in FIG. 1A contains an internally protruding deformable toe absorber 120 and an internally protruding deformable vamp absorber 140. The vamp, as is known to one of skill in the art, is the portion of footwear that covers the instep and can, on occasion, cover the toe as well. Both the toe absorber 120 and the vamp absorber 140, are an integral part of the overshoe 130 and create visible depressions on the surface of the overshoe 130 that protrude down into the overshoe 130.

Figure 1B:
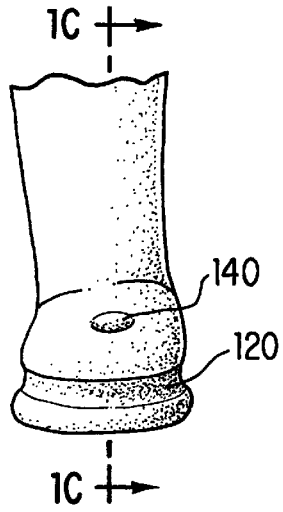
FIG. 1B illustrates a frontal view of the embodiment illustrated in FIG. 1A.

FIG. 1B is a front view of the overshoe in FIG. 1A. As can be seen, the toe absorber 120 wraps around the entire front of the overshoe 130 and extends down the side of the overshoe 130. The toe absorber 120 is wrapped in this manner in order to assist in aligning the various styles and sizes of footwear placed within the overshoe 130 and to functionally secure the footwear to the overshoe 130 when the wearer takes a step. FIG. 1B also illustrates the location and size of the vamp absorber 140. As is evident, the vamp absorber 140 is located in the center of the overshoe, on top of the instep, and does not extend down the sides of the overshoe 130. In an alternative embodiment, however, the vamp absorber 140 could be designed to extended down the sides of the shoe without departing from the spirit and scope of the present invention.

Figure 1C:
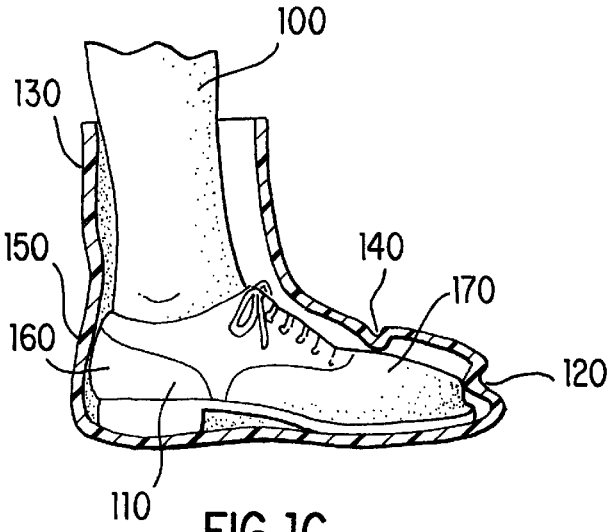
FIG. 1C illustrates a cross-sectional view along section line 1C of FIG. 1B exposing a wearer's lower leg and shoe.

FIG. 1C is a side cross-sectional view taken along section line 1C of FIG. 1B. FIG. 1C exposes a wearer's leg 100 and shoe 110 placed within the overshoe 130. As noted, the overshoe 130 has been formed to include a vamp absorber 140 and a toe absorber 120. The overshoe 130 has also been shaped to define an over the shoe heel cup 150, which has been curved to accept the heel 160 of the shoe 110. In this embodiment, both the vamp absorber 140 and the toe absorber 120 are integral parts of the overshoe 130. Both absorbers are made from the same material as the overshoe and have been molded into the overshoe as a feature of the overshoe 130 during the overshoe's manufacture. The material that the overshoe is made from can include elastomeric materials such as rubber and rubber-like polymers, it can also include PVC or some other similar compound known to one of skill in the art. The manufacturing of the overshoe 130 can be accomplished through various methods known in the art including injection molding, compression molding, slush molding, and layed-up construction.

In use, the deformable toe absorber 120 has been sized to maintain sufficient force against the heel 160 of the shoe 110 in order to keep the heel 160 within the over the shoe heel cup 150 during each step. The toe absorber 120 has also been sized to maintain sufficient force and pressure along the sides of the shoe 110 to facilitate the guiding of the shoe into place and to hold the toe 170 of the shoe 110 in the center of the overshoe 130 during each step. The vamp absorber 140 maintains sufficient force on the top of the shoe 110 to preclude the top of the shoe 110 from rattling within the overshoe during each step.

Figure 1E:
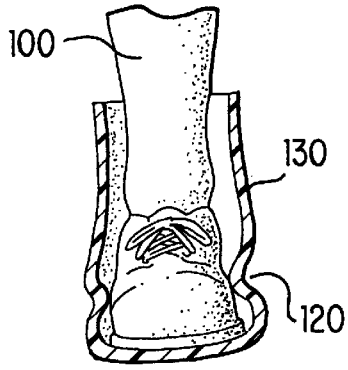
FIG. 1E illustrates a cross-sectional view along section line 1E of FIG. 1A exposing a wearer's lower leg and shoe.
Figure 1D:
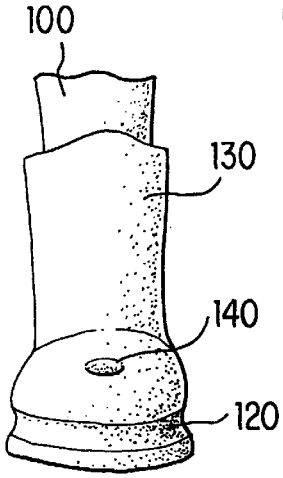
FIG. 1D illustrates a frontal view of the embodiment illustrated in FIG. 1A.

FIG. 1D illustrates the frontal view of the same overshoe illustrated in FIG. 1A. The lower leg 100 of the wearer is shown. As is evident, the overshoe illustrated in this embodiment covers the wearer's ankle and lower shin.

FIG. 1E illustrates the cross-sectional view taken along section line 1E of FIG. 1A. Like FIG. 1C, FIG. 1E also exposes the wearer's shoe and lower leg. FIG. 1E illustrates how the toe absorber 120 extends to, touches, and frictionally secures the sides of a shoe 110, when the shoe 110 is placed into the overshoe 130. As noted above, as the wearer of the overshoe walks, the shoe is restrained and grasped by the deformable vamp absorber 140 (not shown in this illustration) and the toe absorber 120 such that the overshoe 130 will move in step with the shoe 110 of the wearer.

Figure 2:
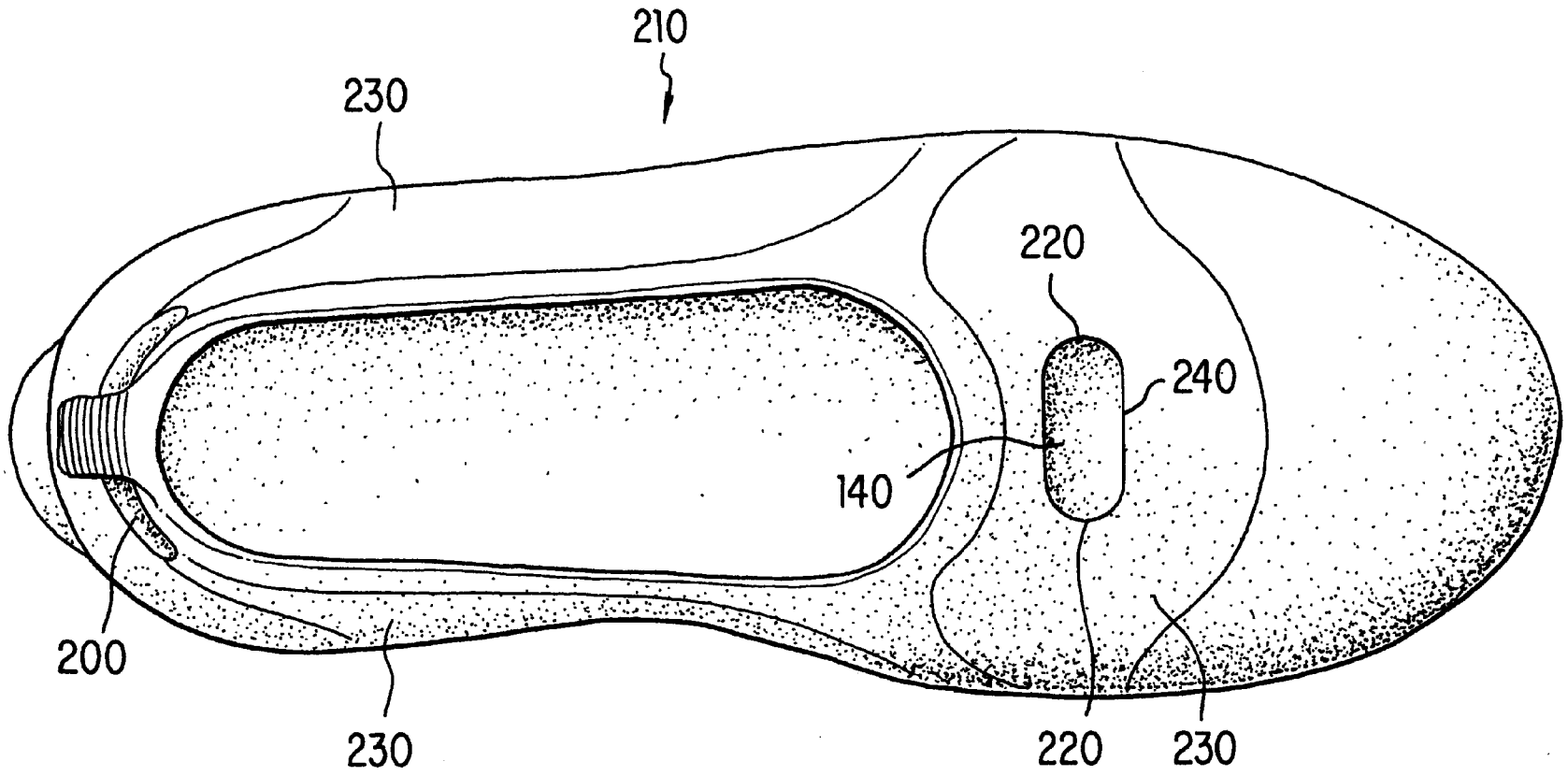
FIG. 2 illustrates a top view of an alternative embodiment of the present invention.

FIG. 2 illustrates a top view of an alternative embodiment of the present invention. In this embodiment a low water proof steel toed galosh 210, having an upper surface 230, utilizes a vamp absorber 140 having two semi-spherical end-spheres 220 and a heel absorber 200 to operably secure the galosh 210 to the wearer's shoe (not shown). The vamp absorber 140 shown in this embodiment forms the shape of half of an obround sphere. This obround sphere has a longitudinal cylindrical portion 240 with a radius of 0.37 inches and two semi-circular end-spheres 220 each also with radii of 0.37 inches. Therefore, at its deepest point, the vamp absorber, like the other absorbers, extends 0.37 inches down into the overshoe. The heel absorber 200 illustrated in FIG. 2 is also in the shape of an obround sphere and also employs radii of curvature of 0.37 inches. In this embodiment, with the absorbers extending 0.37 inches into the overshoe, three different sizes of shoe can be functionally accommodated within the overshoe. Note, however, that a different radius of curvature and shape for the absorbers can also be employed without departing from the spirit and scope of the invention.

The cross-sectional thickness of the absorber itself is consistent with the surrounding cross-sectional thicknesses of the galosh. The absorber can, however, be made thicker or thinner than that of the surrounding material depending upon the surrounding material's properties and the galosh's intended use. As the cross-sectional thickness of the absorber changes so too will its properties. A thicker absorber will provide more resistance and be able to support heavier shoes while a thinner absorber will provide less resistance and be more comfortable for sandal and sock wearers.

Figure 3:
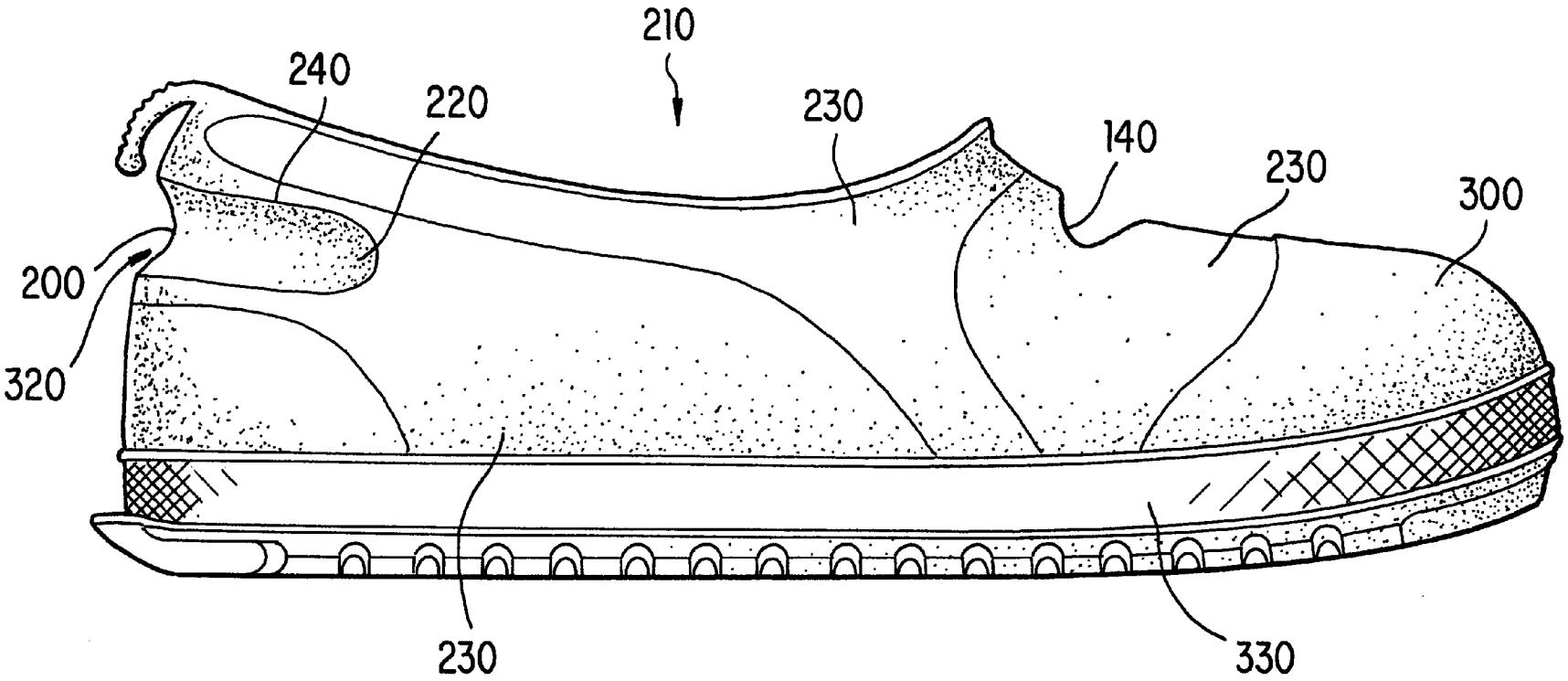
FIG. 3 illustrates a side view of the embodiment illustrated in FIG. 2.

FIG. 3 illustrates a side view of the embodiment shown of FIG. 2 and more clearly shows the upper surface 230 of the galosh and the sole surface 330 or lower surface of the galosh. The steel toe 300 of the galosh 210 and the depression formed by the vamp absorber 140 are also clearly visible in this view.

The heel absorber 200 in FIG. 3 also resembles the shape of an obround sphere. Hereto the radius of curvature of both the long portion 240 of the heel absorber 200 as well as the end-spheres of the heel absorber 200 is 0.37 inches. Note that, as would be expected, the indentation 320 formed by the heel absorber 200 in the heel of the galosh 210 is visibly evident in FIG. 3. However, if the indentation 320 is deemed to be unsightly or unwanted the depression formed by the inwardly facing absorber can be covered up with a masking material or can be filled with a second material, such as a foam, to fill the void. Similarly, the vamp absorber 140, could also be filled or covered up to change the exterior appearance of the galosh 210 without departing from the spirit and intent of the present invention.

Figure 4B:
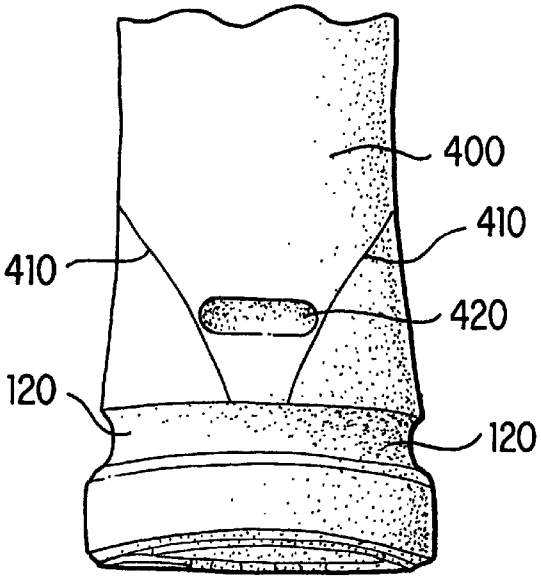
FIG. 4B illustrates a front view of the embodiment of FIG. 4A.
Figure 4A:
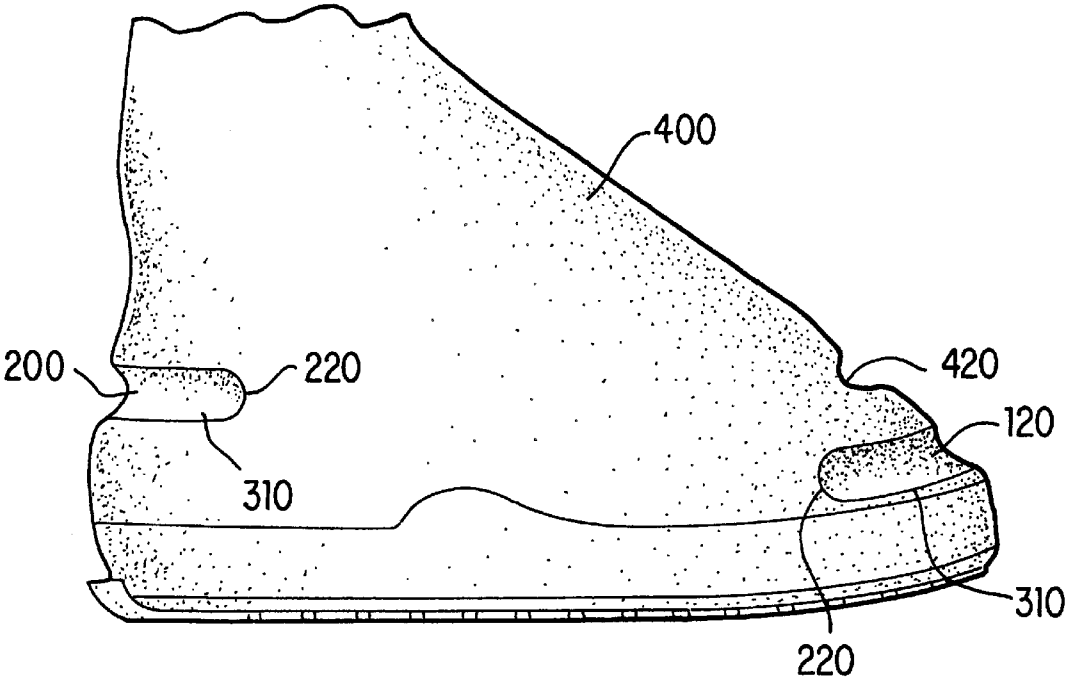
FIG. 4A illustrates a side view of another alternative embodiment of the present invention.

FIG. 4A illustrates a metatarsal protective boot as an alternative embodiment of the present invention. As is known a metatarsal protective boot is a shoe designed to protect against industrial crushing and impact hazards. The metatarsal protective boot 400 contains a heel absorber 200, a top absorber 420, and a toe absorber 120. In this application, because of the slope associated with the front end of the metatarsal protective boot cover 400, designed to deflect falling objects, the top absorber 420, is located closer to the toe than the vamp absorber 140 has been in the previous embodiments. As in the previous embodiments, the radii of curvature, of each of the absorbers, both at the spherical end-spheres 220 and in the cylindrical bodies 240, is also 0.37 inches. The heel absorber 200 extends approximately 2.0 inches towards the toe of the shoe from the heel and the toe absorber 120 extends approximately 2.125 inches towards the heel of the shoe, along the side of the shoe, back from the toe of the shoe.

FIG. 4B illustrates a frontal view of the boot illustrated in FIG. 4A. This frontal view clearly illustrates the location of the top absorber 420 situated between the two contour lines 410. The internal absorbers described above do not need to be molded as an integral part of the overshoe. Instead, the deformable absorbers can be inserted and affixed to the inside the overshoe after the overshoe has been formed. This after-forming installation allows the absorbers to be made from a different material than that of the overshoe. It also allows the absorbers to be shaped in ways not readily available through the integrated design and manufacturing methods discussed above. Made of a different material, the size and shape of the absorbers can vary depending upon the material from which they were made. A more pliable material would require a larger, thicker absorber, while a less pliable material would require a smaller, thinner absorber. Similarly, as noted, not only could the properties of the absorbers be changed but the shapes available for forming the absorber could vary as well.

Figure 5:
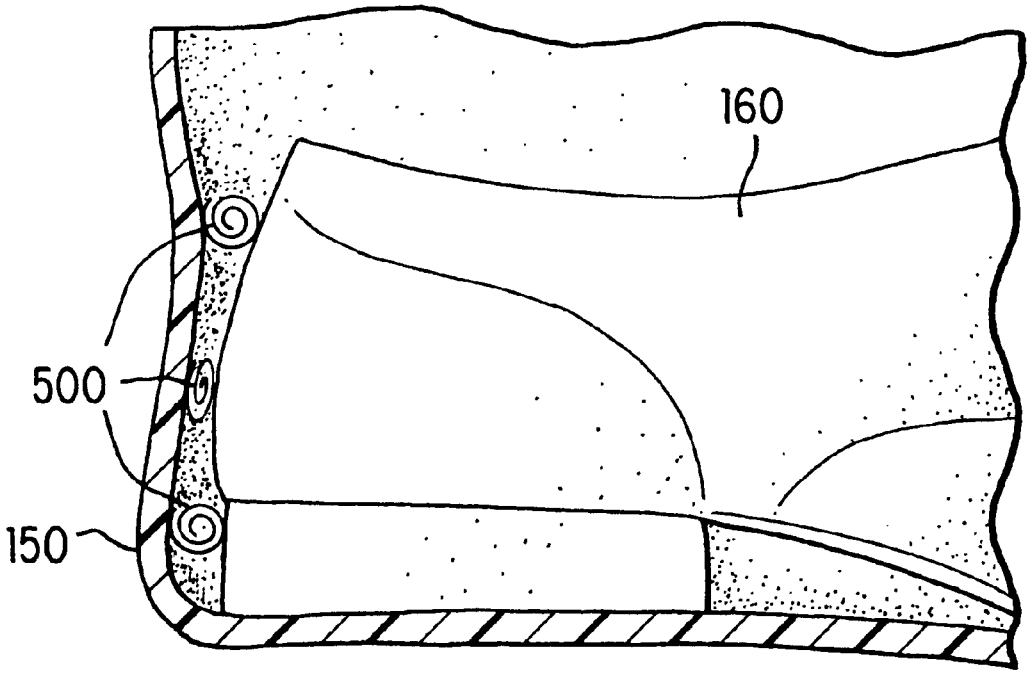
FIG. 5 illustrates an enlarged view of the heel portion of another alternative embodiment of the present invention.
Figure 6:
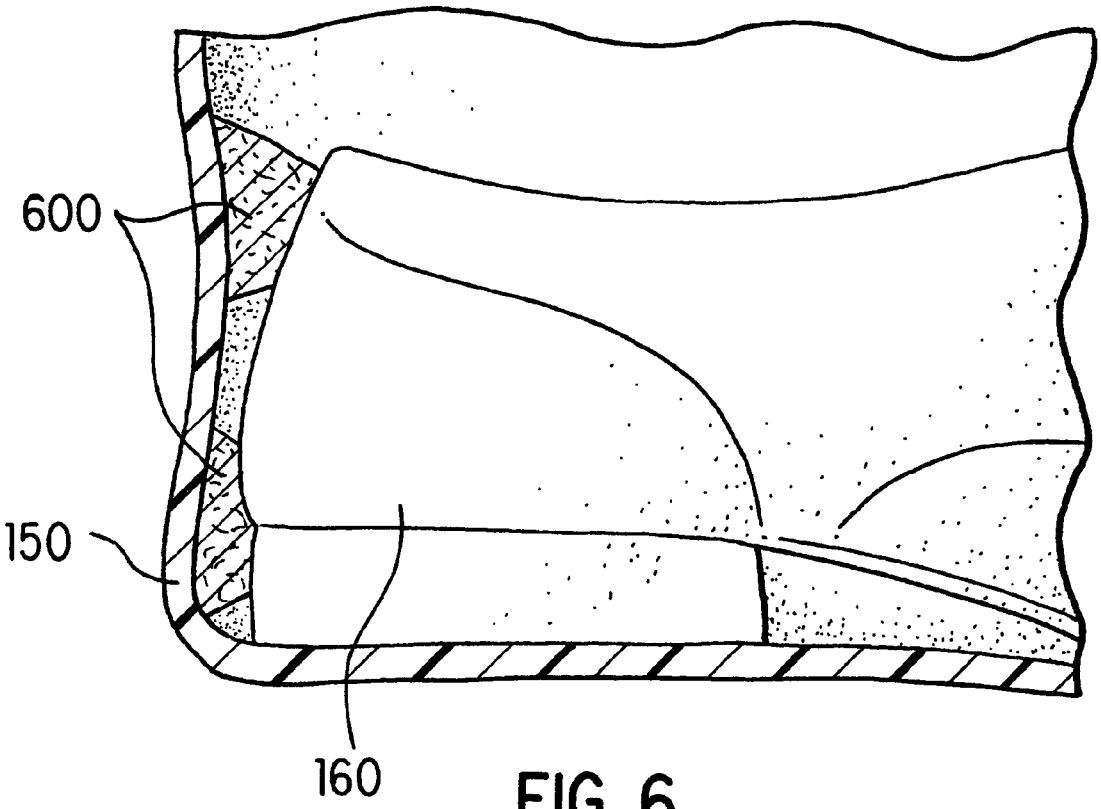
FIG. 6 illustrates an enlarged view of the heel portion of another alternative embodiment of the present invention.

By way of example, an alternative embodiment of the present invention is illustrated in FIG. 5, which is an enlarged view of the over the shoe heel cup 150 and the heel 160 of the shoe 110. Here, rubber coils 500, which would be difficult to integrally form into the overshoe, are employed as absorbers instead of the integral deformable absorbers as discussed above. Similarly, in FIG. 6, which also shows an enlarged view of the heel-cup 150 and the heel 160 of the shoe 110, leather absorbers 600 have been mounted in the overshoe in place of the integral absorbers discussed above. In both of these embodiments the absorbers would be affixed to the overshoe with glue or rivets or some other technique familiar to one of skill in the art. Note that in both FIG. 5 and FIG. 6, as expected, the heel cup 150 does not have an indentation 320 because the absorber is not an integral portion of the overshoe but has instead been placed within it. An advantage of inserting the absorbers in the overshoe after the overshoe has been manufactured is that the properties of the absorbers can vary from the material properties of the overshoe. Alternatively, if the overshoe is not made of injected plastic or rubber and consequently the absorbers can not be readily formed into the overshoe, the post production insertion of the deflection absorbers into the overshoe provides an alternative methodology for placing the deformable absorbers into the overshoe.

A new method and apparatus for securing a shoe into an overshoe has been provided. The disclosed embodiments are illustrative of the various ways in which the present invention may be practiced. Other embodiments can be implemented by those of skill in the art without departing from the spirit and scope of the present invention.

What is claimed is:

1. A method for retaining footwear of various sizes and shapes within an overshoe, without substantially expanding the overshoe, comprising:

providing an overshoe having an upper portion, said upper portion having a vamp portion, a toe portion and a heel portion, said overshoe containing an indentation facing inwardly from an outside surface in said upper portion that forms a first inwardly protruding self-supporting deformable absorber within said upper portion, said first absorber sized to restrain footwear placed within said overshoe; and inserting the footwear into said overshoe.

2. The method of claim 1 wherein said first absorber is located in said vamp portion of said upper portion.

3. The method of claim 1 wherein said first absorber is located in said toe portion of said upper portion.

4. The method of claim 1 wherein said overshoe further contains:

a second inwardly protruding deformable absorber within said upper portion, said second absorber sized to restrain footwear placed within said overshoe.

5. The method of claim 1 wherein said first absorber is located within said heel portion.

6. The method of claim 4 wherein said first absorber is located within said toe portion and said second absorber is located within said heel portion.

7. The method of claim 4 wherein said first absorber is located within said vamp portion of said upper portion and said second absorber is located within said heel portion of said upper portion.

8. A device capable of accepting and operably restraining various types and sizes of footwear comprising:

an overshoe having an upper surface with a toe portion, a vamp portion, a heel portion, and an interior surface;

a sole surface connected to said upper surface; and an elastic self-supporting absorber integrally formed as part of said upper surface;

said absorber sized to deformably restrain footwear placed within said overshoe, said absorber formed from an outside surface indentation, said absorber facing inwardly from the outside surface.

9. The device of claim 8 wherein said absorber is sized to deformably restrain several styles of footwear placed within said overshoe.

10. The device of claim 8 wherein said absorber is sized to deformably restrain several sizes of footwear placed within said overshoe.

11. The device of claim 8 wherein said overshoe contains an elastomeric material.

12. The device of claim 8 wherein said absorber is located in said vamp portion of said upper surface.

13. The device of claim 8 wherein said absorber is located in said toe portion of said upper surface.

14. A system for adapting a footwear cover to align and functionally secure a range of sizes and types of footwear inserted into the footwear cover comprising:

an overshoe having a toe portion with a first depression facing inwardly from an outside surface, wherein when footwear is placed within said overshoe said first depression deflects to operably secure the footwear placed within said overshoe; and wherein after the footwear is inserted into said overshoe, said overshoe substantially maintains its original configuration.

15. The system of claim 14 wherein said overshoe further comprises:

a heel portion containing a second depression.

16. The system of claim 14 wherein said overshoe is made with an elastomeric material.

17. An overshoe for covering footwear comprising:

a galosh having an upper surface;

said upper surface having an indented self-supporting integral means facing inwardly from an outside surface for operably frictionally securing footwear within said galosh without substantially stretching said galosh to secure the footwear.

18. A cover for covering footwear comprising:

an overshoe having an upper portion, said upper portion having, an interior, a toe portion, a heel portion, and a vamp portion; and a compressible self-supporting elastically deformable absorber integrally formed within said interior of said upper portion and facing inwardly from an outside surface, said absorber sized to functionally and compressibly secure footwear within said overshoe, said absorber fabricated from the same material as said overshoe, said absorber completely defining a void.

19. The cover of claim 18 wherein said absorber is positioned at said vamp portion of said upper portion.

20. A cover for covering footwear comprising:

an overshoe having an upper portion, said upper portion having, an interior, a toe portion, a heel portion, and a vamp portion; and a non-inflatable elastically deformable self-supporting absorber positioned within said interior of said upper portion at said vamp portion, said absorber sized to functionally and compressibly secure footwear within said overshoe without substantially expanding the overshoe and said absorber facing inwardly from an outside surface.

21. A cover for covering footwear comprising:

an overshoe having an upper portion, said upper portion having, an interior, a toe portion, a heel portion, and a vamp portion; and a compressible elastically deformable self-supporting absorber positioned within said interior of said upper portion at said toe portion, said absorber passively sized to functionally and compressibly secure footwear within said overshoe without substantially expanding the overshoe, said absorber facing inwardly from an outside surface, said absorber fabricated from the same material as said overshoe.

22. A method for retaining footwear of various sizes and shapes within an overshoe, without substantially expanding the overshoe, comprising:

providing an overshoe having an upper portion, said upper portion having a vamp portion, a toe portion and a heel portion, said overshoe containing an external surface indentation in said upper portion facing inwardly from an outside surface that forms a first inwardly protruding self-supporting deformable absorber within said upper portion, said first absorber sized to restrain footwear placed within said overshoe; and inserting the footwear into said overshoe.

23. The method of claim 22 wherein said first absorber is located in said vamp portion of said upper portion.

24. The method of claim 22 wherein said first absorber is located in said toe portion of said upper portion.

25. The method of claim 22 wherein said overshoe further contains:

locating a second external surface indentation in said upper portion that forms an inwardly protruding deformable absorber within said upper portion, said second absorber sized to restrain footwear placed within said overshoe.

26. The method of claim 22 wherein said first absorber is located within said heel portion.

27. The method of claim 26 wherein said first absorber is located within said toe portion and said second absorber is located within said heel portion.

28. The method of claim 26 wherein said first absorber is located within said vamp portion of said upper portion and said second absorber is located within said heel portion of said upper portion.

29. A device capable of accepting and operably restraining various types and sizes of footwear comprising:

an overshoe having an upper surface with a toe portion, a vamp portion, a heel portion, and an interior surface;

a sole surface connected to said upper surface; and an elastic self-supporting absorber integrally formed as part of said interior surface of said upper surface, said absorber facing inwardly from an outside surface and sized to deformably restrain footwear placed within said overshoe, said absorber defining a cavity.

30. The device of claim 29 wherein said absorber is sized to deformably restrain several styles of footwear placed within said overshoe.

31. The device of claim 29 wherein said overshoe contains an elastomeric material.

32. The device of claim 29 wherein said absorber is located in said vamp portion of said upper surface.

33. The device of claim 29 wherein said absorber is located in said toe portion of said upper surface.

34. A system for adapting a footwear cover to align and functionally secure a range of sizes and types of footwear inserted into the footwear cover comprising:

an overshoe having an upper surface with a first inwardly directed absorber, facing inwardly from an outside surface and forming an indentation on the outside surface, wherein when footwear is placed within said overshoe said first absorber deflects at a rate greater than said upper surface to operably secure the footwear placed within said overshoe and wherein after the footwear is inserted into said overshoe, said overshoe substantially maintains its original configuration.

35. The system of claim 34 wherein said overshoe further comprises:

a heel portion of said upper surface containing an inwardly directed absorber.

36. The system of claim 34 wherein said overshoe is made with an elastomeric material.

37. An overshoe for covering footwear comprising:

a galosh having an upper surface, said upper surface having a self-supporting integral means for operably frictionally securing footwear within said galosh without substantially stretching said galosh to secure the footwear, said integral means defining a cavity, said integral means facing inwardly from an outside surface and forming an indentation on the outside surface.

* * * * *